United States Patent [19]

Tanaka

[11] Patent Number: 4,486,108

[45] Date of Patent: Dec. 4, 1984

[54] SEMI-AUTOMATIC PAPER INSERTION APPARATUS

[75] Inventor: Yoshitsugu Tanaka, Yokohama, Japan

[73] Assignee: Ricoh Company Ltd., Japan

[21] Appl. No.: 318,410

[22] Filed: Nov. 5, 1981

[30] Foreign Application Priority Data

| | | | |
|---|---|---|---|
| Nov. 6, 1980 | [JP] | Japan | 55-156223 |
| Nov. 6, 1980 | [JP] | Japan | 55-156224 |
| Nov. 11, 1980 | [JP] | Japan | 55-159106 |

[51] Int. Cl.[3] ..... B41J 13/02

[52] U.S. Cl. ..... 400/639.1; 400/637.1; 400/637.5

[58] Field of Search ..... 400/637, 637.1, 637.2, 400/637.3, 637.4, 637.5, 637.6, 639, 639.1, 639.2

[56] References Cited

U.S. PATENT DOCUMENTS

| | | | |
|---|---|---|---|
| 1,270,292 | 6/1918 | Hess | 400/637.4 X |
| 1,608,850 | 11/1926 | Going | 400/637.3 X |
| 2,094,011 | 9/1937 | Helmond | 400/637.5 X |
| 2,131,149 | 9/1938 | Smith | 400/637.1 |
| 3,960,258 | 6/1976 | Aebi | 400/639.1 X |
| 4,266,880 | 5/1981 | Buchanan | 400/639.1 X |
| 4,275,969 | 6/1981 | Matsuhisa et al. | 400/639.1 X |

FOREIGN PATENT DOCUMENTS

| | | | |
|---|---|---|---|
| 2526445 | 12/1976 | Fed. Rep. of Germany | 400/639.1 |
| 0126470 | 9/1980 | Japan | 400/639.1 |

OTHER PUBLICATIONS

IBM Technical Disclosure Bulletin, "Delayed Motion Cam-Actuated Switch", Kroeker, vol. 21, No. 9, Feb. 1979, pp. 3459-3460.

IBM Technical Disclosure Bulletin, "Paper-Insertion Apparatus For A Typewriter Having A First-Line Distance Option", Dobson et al., vol. 21, No. 10, Mar. 1979, pp. 4107-4108.

IBM Technical Disclosure Bulletin, "Power-Operated Paper Insert Automatically Utilizing Triple Pitch For Typewriter", Lennon, vol. 22, No. 2, Jul. 1979, pp. 661-663.

IBM Technical Disclosure Bulletin, "Automatic First Writing Line Mechanism", Sweat, Jr., vol. 23, No. 9, Feb. 1981, pp. 3961-3964.

Xerox Disclosure Journal, "Paper Bail Actuator", Kockler et al., vol. 4, No. 5, Sep./Oct. 1979, pp. 677-678.

*Primary Examiner*—Ernest T. Wright, Jr.
*Attorney, Agent, or Firm*—Guy W. Shoup

[57] ABSTRACT

A semi-automatic paper insertion apparatus for a printer, a typewriter, etc. comprising a first condition in which the paper bail is out of engagement with the platen and the paper feed drive source is actuated and a second condition in which the paper bail is in engagement with the platen and the paper feed drive source is actuated, comprises further a third condition in which the paper bail is out of engagement with the platen and the paper feed drive source is deactuated, whereby a skew correcting operation can be performed without any trouble.

2 Claims, 14 Drawing Figures

SEMI-AUTOMATIC PAPER INSERTION APPARATUS

BACKGROUND OF THE INVENTION

This invention relates to a semi-automatic paper insertion apparatus for a printer, typewriter, etc.

Heretofore, an electronic typewriter has been provided with a semi-automatic paper insertion apparatus in some applications, and U.S. Pat. No. 4,266,880 discloses one type of paper insertion apparatus, for example, in which the paper bail is movable between two stable positions or a position in which it is in contact with the platen and a position in which it is moved away from the platen, so that the paper feed drive source can be actuated when the paper bail is moved away from the platen, to start feeding of paper.

Besides the aforesaid type of paper feeding operation, a skew correcting operation should be performed, for example, when the paper bail is located in a position in which it is moved away from the platen. When the skew correcting operation is performed, the paper feed drive source is actuated as the paper bail is moved away from the platen. Thus the paper bail might interfere with other necessary operations and trouble might be caused. Also, when paper insertion is effected by moving the paper bail away from the platen, paper feed is effected by simultaneously setting a desired printing initiating position in this condition, so that when the feeding of paper covers a large distance there might be the risk that the paper fed might not move along the platen and catch at its leading end against the inner surface of the cover.

In another type of paper insertion apparatus, means is provided for moving the pressure rollers into and out of contact with the platen so as to perform the operation of moving the pressure rollers and the paper bail into and out of contact with the platen by a single lever linking the paper bail to the pressure rollers. In this type of apparatus, it would be impossible to move the pressure rollers away from the platen while the paper bail is kept in contact with the platen, by actuating the lever to effect switching. The result of this would be that it would be impossible to use a page feeder including sprocket apertures formed on opposite sides of the paper and sprocket wheels engaging the sprocket apertures.

SUMMARY OF THE INVENTION

This invention has been developed for the purpose of obviating the aforesaid disadvantages of the prior art. Accordingly the invention has as its object the provision of a semi-automatic paper insertion apparatus capable of effecting paper feed and a skew correcting operation without any trouble as occasion demands.

Another object of the invention is to provide a semi-automatic paper insertion apparatus capable of using a page feeder without spoiling the operativity of the apparatus.

Additional and other objects, features and advantages of the invention will become apparent from the description set forth hereinafter when considered in conjunction with the accompanying drawing.

DESCRIPTION OF THE PREFERRED EMBODIMENTS

Figure 1:
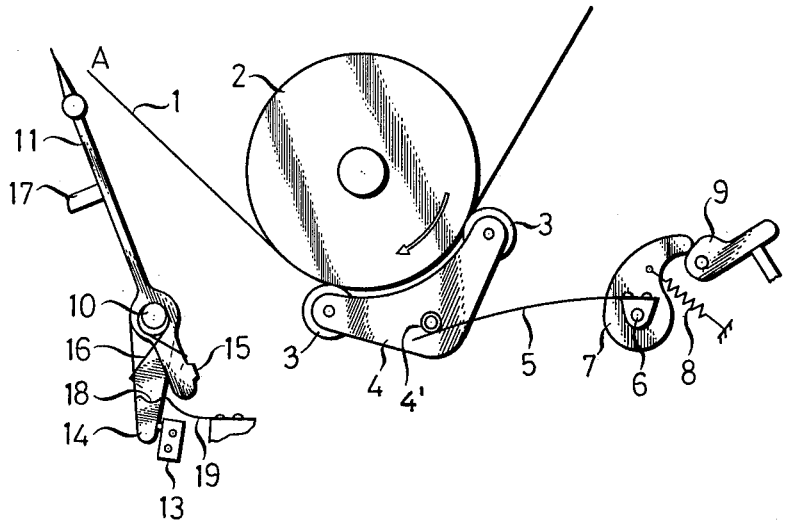
FIG. 1 is a side view of the semi-automatic paper insertion apparatus comprising a first embodiment of the invention, shown in a first condition.

A first embodiment of the invention will be described by referring to FIGS. 1 and 2. The semi-automatic paper insertion apparatus comprises a pair of pressure rollers 3 disposed in juxtaposed relation to a platen 2 for bringing paper 1 into contact with the latter. The pair of pressure rollers 3 are supported by a roller support plate 4 and biased by a plate spring 5 bearing against a pin 4' toward the platen 2. Mounted on a shaft 6 supporting the plate spring 5 is a lever 7 which is urged by a spring 8 to press against a release cam lever 9.

Figure 6:
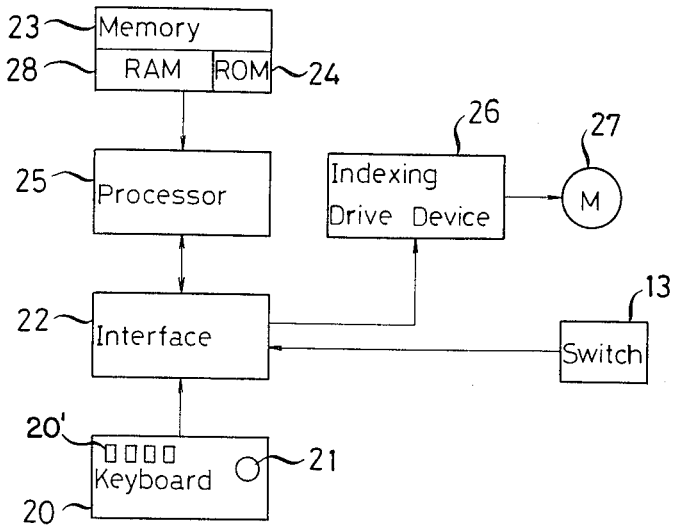
FIG. 6 is a block circuit diagram suitable for operating the paper insertion apparatus according to the invention.
Figure 7:
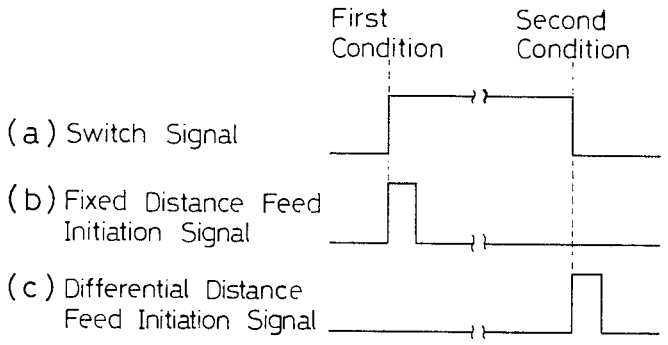
FIG. 7 is a timing chart for operation of the apparatus shown in FIGS. 1–3.

A paper bail 11 pivotable about a shaft 10 is juxtaposed against the platen 2 and has attached to its lower end portion a toggle spring 12 (see FIG. 4) which is operative to hold the paper bail 11 stably between a first position in which the paper bail 11 is moved away from the platen 2 and a second position in which the paper bail 11 is in contact therewith. A switch 13 for supplying a signal to a paper feed drive source, denoted by indexing motor 27 in FIG. 6, is located beneath the paper bail 11, and a switch lever 14 for turning on and off the switch 13 is pivotally supported by the shaft 10 so that it is rotatably mounted in overlapping relation to the paper bail 11. The paper bail 11 has a bent portion 15 moving the switch lever 14 as a unit therewith when it has moved to the second position. A torsion spring 16 of a predetermined resilience is mounted between the paper bail 11 and the switch lever 14 normally urging the two elements into overlapping relation. When released from the second position, paper bail 11 can be located stably in the first position in which the paper bail 11 is out of engagement with the platen 2 and regulated by a stopper 17 while the toggle spring 12 is reversed in the direction of its operation. A resilient member 19 cantilevered and formed with a recess 18 for receiving the lower end of the paper bail 11 is located beneath the shaft 10. Thus as the paper bail 11 is released from engagement with the platen 2 while its lower end is in engagement with the recess 18, the paper bail 11 is maintained securely in a third position. The movement of the paper bail 11 between the first position and the third position through the second position is followed by the on-off action of the switch 13 in such a manner that only when the paper bail 11 is slightly biased substantially from the intermediate position between the third and the first position in a direction remote from the platen 2 is the switch 13 turned on by the biasing force of the torsion spring 16.

Figure 4:
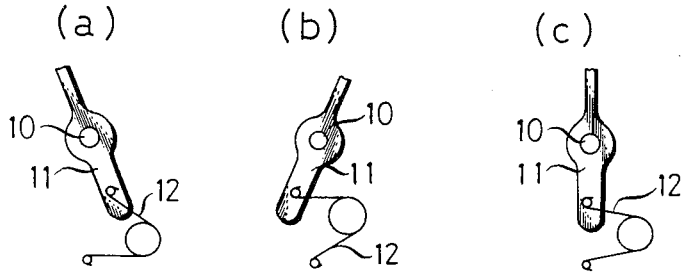
FIGS. 4(*a*), 4(*b*) and 4(*c*) are views showing the toggle spring in positions corresponding to the first condition, second condition and third condition of the apparatus shown in FIGS. 1–3 respectively.

In this construction, a paper feed setting operation is performed as follows. Firstly, the paper 1 is inserted between the platen 2 and the pressure rollers 3 in such a manner that the leading end of the paper 1 is positioned against the contact position between them. Then, the paper bail 11 is moved from the second position to the first position as shown in FIG. 1, away from the platen 2. With this shifting of the paper bail 11 to the first position from the second position, the toggle spring 12 stably forces the paper bail 11 against the stopper 17 as shown in FIG. 4(*a*) to thereby hold the latter in the first position. At this time, the switch lever 14 released from the paper bail 11 is driven with a pressing force for turning on the switch 13 by the biasing force of the torsion spring 16 as the paper bail 11 nears the first position, to thereby turn on the switch 13. The elements of the apparatus shown in FIG. 1 are in the first condition. Actuation of the paper feed drive source, denoted by motor 27, starts feeding of paper 1 for a predetermined distance, to bring the leading end of the paper 1 to a position designated by the symbol A shown in FIG. 1.

Figure 2:
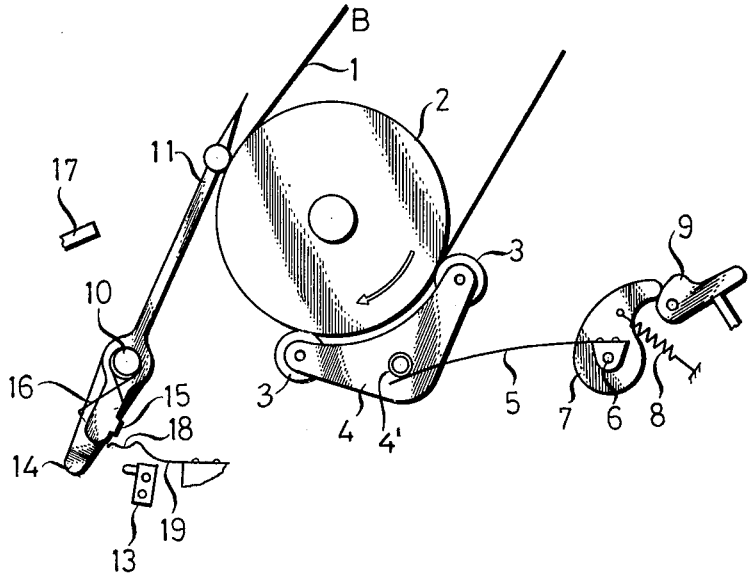
FIG. 2 is a side view of the apparatus shown in FIG. 1, shown in a second condition.

The paper bail 11 is angularly rotated from the first position shown in FIG. 1 to the second position shown in FIG. 2 in which it engages the platen 2. This causes the toggle spring 23 to move to hold the paper bail 11 securely in the second position, as shown in FIG. 4(*b*). Thus the apparatus is brought to the second condition. In this process, as the paper bail 11 is moved from the first position to a certain degree, the switch 13 is turned off and generates an OFF signal or a trailing signal which feeds the paper 1 from position A to a position in which printing is desired to be started. The paper 1 stops in position B in FIG. 2, thereby completing the operation of setting the paper 1.

Figure 5:
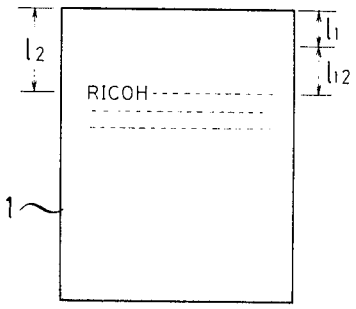
FIG. 5 is a plan view of the paper to be fed.

Control of the distance for the paper 1 to be fed will be described. As shown in FIG. 5, a fixed distance or $l_1$ is set beforehand for each paper 1 (which distance corresponds to 6 lines, for example). Assume that the position of a distance $l_2$ corresponding to 14 lines from the leading end of the paper 1 is the position in which printing is desired to be initiated. Firstly, the desired printing initiating position is set at the 14th line by manipulating a digit key 20' on a keyboard 20 or actuating an indexing dial switch 21 shown in FIG. 6. As the paper bail 11 is moved to the first position while the paper 1 is being kept in engagement with the platen 2 and the pressure rollers 3, the switch 13 supplies a signal to an interface 22 which receives the leading signal from the switch 13 and retrieves from a processor 25 the distance $l_1$ (6 lines) stored in an ROM region 24 of a memory 23. Indexing drive circuit 26 for the paper feed drive source 27 is actuated by a fixed distance feed initiating strobe signal, so that feeding of the paper 1 for the fixed distance $l_1$ is carried out by an indexing motor 27. This brings about the first condition shown in FIG. 1. The fixed distance $l_1$ is set such that when the paper bail 11 is brought to the second position, the paper bail 11 is able to press against the vicinity of the leading end of the paper 1 or the leading end of the paper 1 slightly sticks out of the position in which the paper bail 11 and the platen 2 are in contact with each other. After feeding of the paper 1 for the fixed distance $l_1$ is ascertained, the paper bail 11 is moved to the second position. This causes the switch 13 to produce a trailing signal to enable feeding of the paper 1 for a distance corresponding to the differential $l_{12}$ (8 lines in this case) between the distance $l_2$ to the desired printing initiating position designated by the indexing dial switch 21 and the fixed distance $l_1$ to be carried out by a differential feed initiating strobe signal. This sets the paper 1 in the position shown in FIG. 2. The distance $l_2$ to the desired printing initiating position is stored in a RAM region 28 of the memory 23, and the differential $l_{12}$ is calculated by the processor 25. Since the paper 1 is not fed to the desired printing initiating position when the paper bail 11 is in the first position, but the feeding of the paper 1 is carried out for a distance corresponding to the differential $l_{12}$ as the paper is held down by the paper bail 11, there is no risk of the paper 1 being jammed while it is fed along the platen 2.

Figure 3:
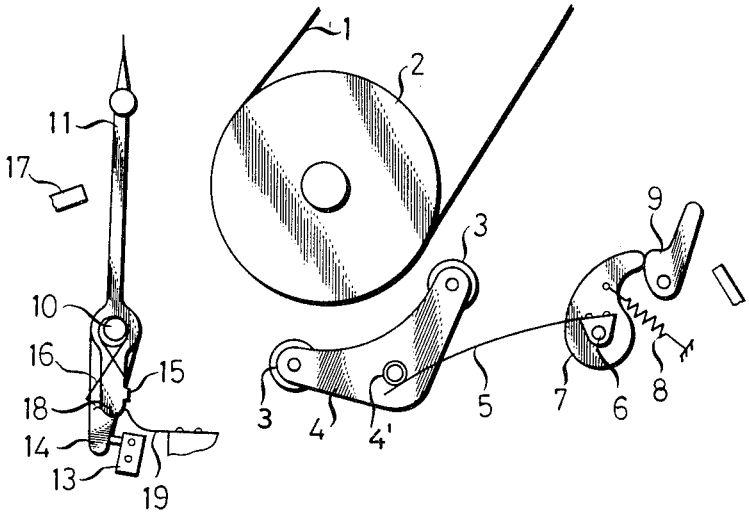
FIG. 3 is a side view of the apparatus shown in FIG. 1, shown in a third condition.

Meanwhile a skew correcting operation is performed by moving the paper bail 11 to the third position, to bring the apparatus to the third condition shown in FIG. 3. More specifically, the paper bail 11 is held in a substantially vertical position when moved to the third position in which its lower end engages the recess 18 of the resilient member 19. At this time, the toggle spring 12 is in condition as shown in FIG. 4(*c*) in which it exerts no force tending to overcome the force of the resilient member 19 to move the paper bail 11 from the third position. When the apparatus is in this condition, the torsion spring 16 exerts a force which is too low to turn on the switch 13, thereby keeping the paper feed drive source 27 deactuated. Upon manipulating the release cam lever 9 to move the pressure rollers 3 away from the platen 2, skew of the paper 1 can be corrected. Thus in performing a skew correcting operation, the paper bail 11 is held in a position away from the platen 2 as in the first condition. However, since the switch 13 is kept in an OFF position to prevent the paper feed drive source 27 from being actuated, no feeding of the paper 1 takes place and skew correction can be carried out without any interference.

Figure 8:
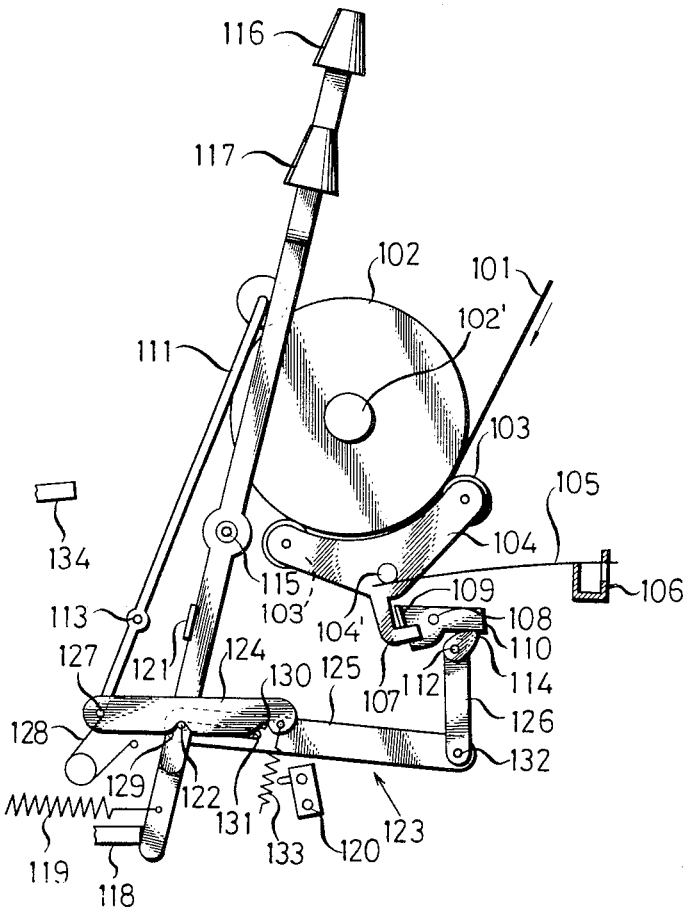
FIG. 8 is a side view of the semi-automatic paper insertion apparatus comprising a second embodiment of the invention, shown in a condition in which the lever is located in a first position.
Figure 9:
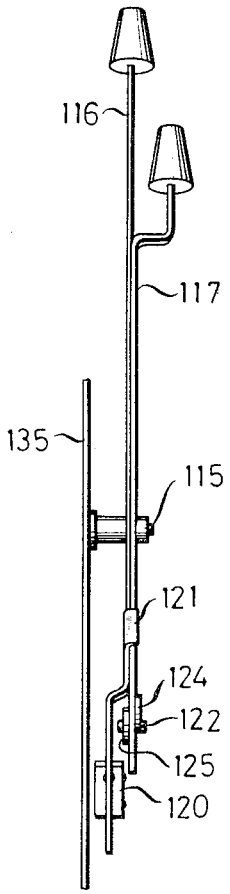
FIG. 9 is a front view of certain parts of the apparatus shown in FIG. 8 in the aforesaid condition.

In the second embodiment of the invention shown in FIGS. 8 and 9, pressure rollers 103 supported by a roller support plate 104 are positioned against a platen 102 journalled on a shaft 102'. The pressure rollers 103 are driven with a predetermined pressing force acting on the platen 102 by a plate spring 105 bearing against a pin 104' and supported at its pivot side by a stay 106 substantially in the form of a letter U in a lying position secured to a frame 135. The roller support plate 104 has at its lower end a locking member 107 substantially in the form of a letter U in a lying position. A lever 110 pivotable about a pin 108 and formed with a bent release member 109 adapted to be brought into locking engagement with the locking member 107 in a counterpressing direction is located beneath the roller support plate 104. A release cam 114 operative to serve as releasing means for controlling the lever 110 is rotatably supported by a pin 112. A paper bail 111 is supported on a shaft 113 for rotation into and out of engagement with the platen 102.

Figure 10:
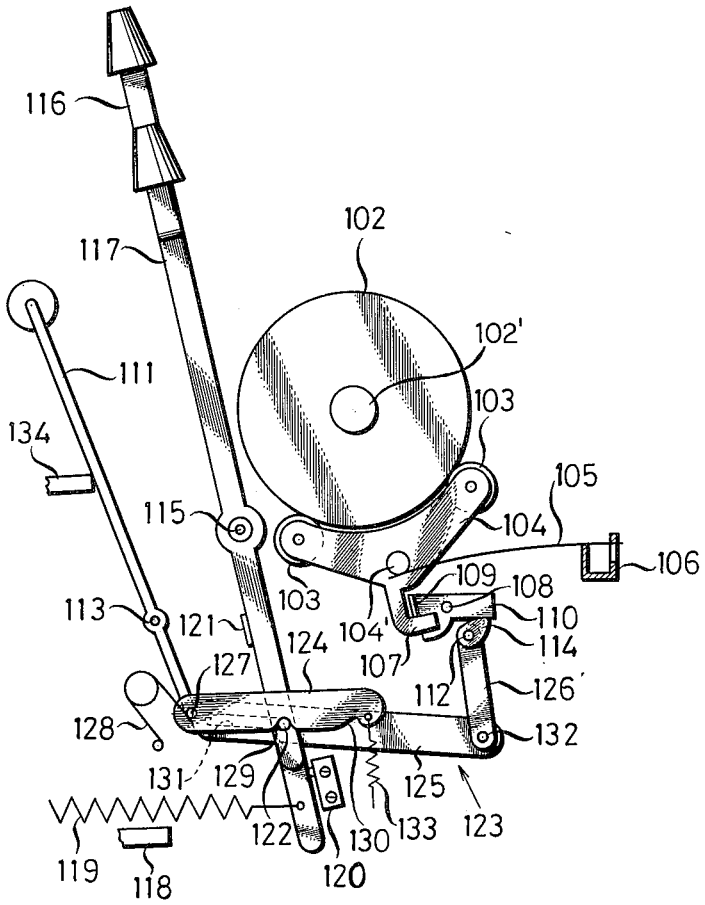
FIG. 10 is a side view of the apparatus shown in FIG. 8, shown in a condition to which it has transferred after the lever is switched to a second position.

An automatic setting lever 116 and a lever 117 are pivotally supported by a shaft 115 which in turn is supported vertically by frame 135 in a position substantially midway between the shaft 102' of the platen 102 and the shaft 113. The automatic setting lever 116 has a greater length than the lever 117 and is urged at its lower end by a spring 119 to move toward a stopper 118. The automatic setting lever 116 is in a first position when it abuts against the stopper 118 as shown in FIG. 8. A switch 120 is provided for actuating paper feed drive source 27, when the automatic setting lever 116 is moved away from the stopper 118. When the automatic setting lever 116 is moved in pivotal movement to turn on the switch 120 as shown in FIG. 10, the automatic setting lever 116 is in a second position. The automatic setting lever 116 and the lever 117 are in overlapping relation, and an engaging member 121 formed on the automatic setting lever 116 links the lever 116 to the lever 117 so that when the former is switched from the first position to the second position, the latter moves together with the former.

Meanwhile the lever 117 is able to move to a third position in which it is removed from the platen, 102 besides a first position and a second position corresponding to those of the automatic setting lever 116. A pin 122 is attached to the lower end portion of the lever 117.

A linkage 123 is provided which is connected to the release cam 114, paper bail 111 and lever 117 and is essentially composed of three links 124, 125 and 126, with the links 124 and 125 holding the lever 117 therebetween at pin 122 as shown in FIG. 9. The link 124 is connected at one end thereof to the lower end of the paper bail 111 by a pin 127 which is connected to a toggle spring 128. The link 124 is formed at its lower edge with two recesses 129 and 130 spaced apart from each other a predetermined distance for the pin 122 to be brought into and out of engagement therein. The link 125 is formed at one end thereof with a slot 131 of a predetermined length for the pin 122 to engage therein, while the other end of the link 125 is connected through a pin 132 to the link 126 supported on the pin 112. The link 124 is biased downwardly by a spring 133. A stopper 134 is provided for limiting the position to which the paper bail 111 moves when released from engagement with the platen 102.

In the aforesaid construction, the apparatus is in the condition shown in FIG. 8 when the automatic setting lever 116 and the lever 117 are both in the first position. That is, the release cam 114 prevents the lever 110 from acting on the pressure rollers 103 to allow the pressure rollers 103 to remain in engagement with the platen 102 by virtue of the pressing force exerted by the plate spring 105. The paper bail 111 is kept in engagement with the platen 102 by virtue of the resilience of the toggle spring 128 as in the second condition of the first embodiment. At this time, the pin 122 is positioned in the recess 129 with respect to the link 124 and on the left side of the slot 131 with respect to the link 125.

Upon the automatic setting lever 116 being switched from the first position shown in FIG. 8 to the second position shown in FIG. 10 after paper 101 is inserted between the pressure rollers 103 and the platen 102, the switch 120 is turned on by the automatic setting lever 116. At this time, the lever 117 also moves from the first position to the second position because it is linked to the automatic setting lever 116 by the engaging member 121. During movement of the lever 117 to the second position the pin 122 is kept in engagement in the recess 129 and the link 124 is moved rightwardly, so that the paper bail 111 moves in pivotal movement about a shaft 113 away from the platen 102. The paper bail 111 is forced by the toggle spring 128 against the stopper 134 so as to be securely held in place. Meanwhile the pin 122 merely moves from the left end of the slot 131 to the right end thereof with respect to the link 125 and does not move the link 125 rightwardly. Thus the link 126 and the release cam 114 do not perform a releasing operation, and the pressure rollers 103 remain in pressing engagement with the platen 102. By merely moving the automatic setting lever 116 from the first position to the second position as aforesaid, it is possible to bring about the first condition of the first embodiment in which only the paper bail 111 is out of engagement with the platen 102 and the switch 120 is turned on. As a result, a signal is supplied to the paper feed drive source 27 to effect feeding of the paper 101 for a predetermined distance. The automatic setting lever 116 automatically returns from the second position to the first position if the hand is removed therefrom because it is urged by the biasing force of the spring 119. After feeding of the paper 101 for a predetermined distance is effected, the link 124 moves leftwardly and the paper bail 111 returns to the condition shown in FIG. 8 as the lever 117 is returned from the second position to the first position, thereby completing a paper feeding operation.

Figure 11:
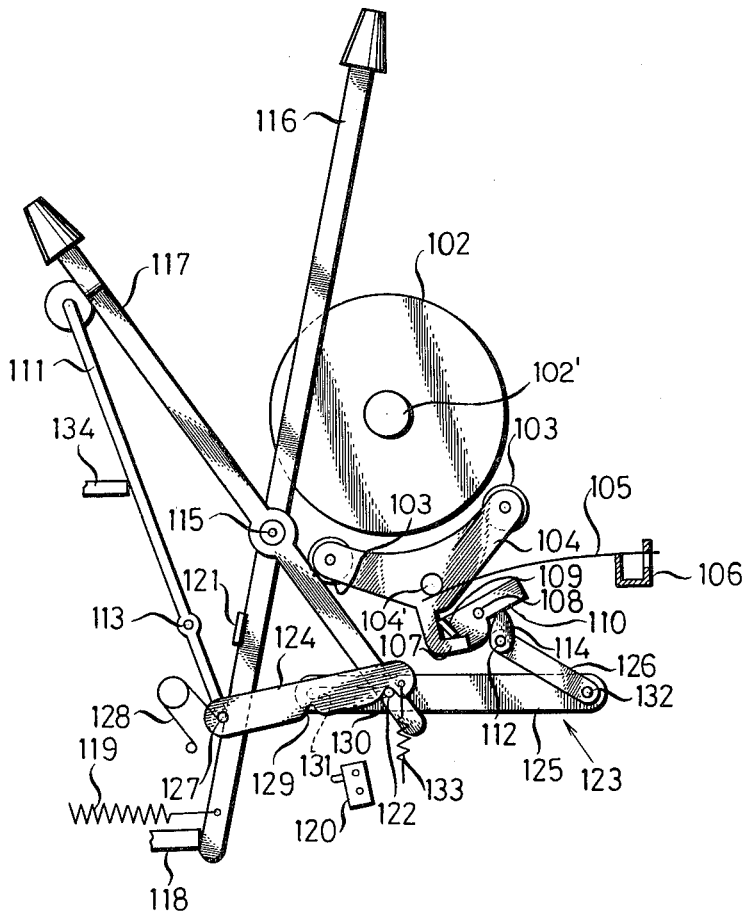
FIG. 11 is a side view of the apparatus shown in FIG. 8, shown in a condition to which it has transferred after the lever is switched to a third position.

When a skew correcting operation or other operation is performed, it is necessary to bring the pressure rollers 103 and the paper bail 111 away from the platen 102. This is attained by moving the lever 117 from the first position to the third position through the second position. When the lever 117 is in the second position, only the paper bail 111 is moved away from the platen 102 and the pressure rollers 103 are not moved away therefrom as shown in FIG. 10. At this time, the automatic setting lever 116 is in the first position and the switch 120 is not turned on. As the lever 117 is moved to the third position, a third condition shown in FIG. 11 is brought about. More specifically, since the link 124 is unable to move rightwardly farther than when the lever 117 is in the second position, the pin 122 is released from engagement in recess 129 and moves along the lower edge of the link 124 into engagement in the next following recess 130. Meanwhile on the link 125 side, the pin 122 is positioned on the right end of the slot 131 when the lever 117 is in the second position, so that the link 125 moves rightwardly as the lever 117 moves to the third position in which the pin 122 engages in the recess 130. This allows the link 126 to move counterclockwise in pivotal movement, to thereby cause the release cam 114 to move counterclockwise in pivotal movement, so that the release member 109 of the lever 110 moves the roller support plate 104 downwardly through the locking member 107, to thereby move the pressure rollers 103 away from the platen 102. In this way, movement of the lever 117 to the third position enables the pressure rollers 103 and the paper bail 111 to move away from the platen 102, thereby allowing a skew correcting operation and other operation to be performed.

Figure 12:
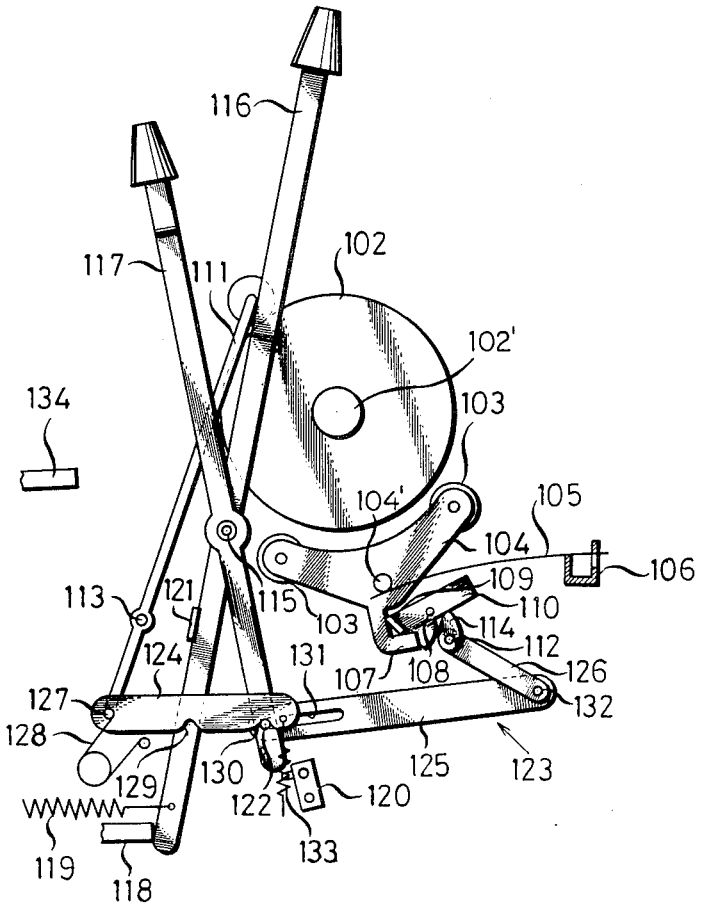
FIG. 12 is a side view of the apparatus shown in FIG. 8, shown in a condition to which it has transferred after the lever is switched from the third position to the second position.
Figure 13:
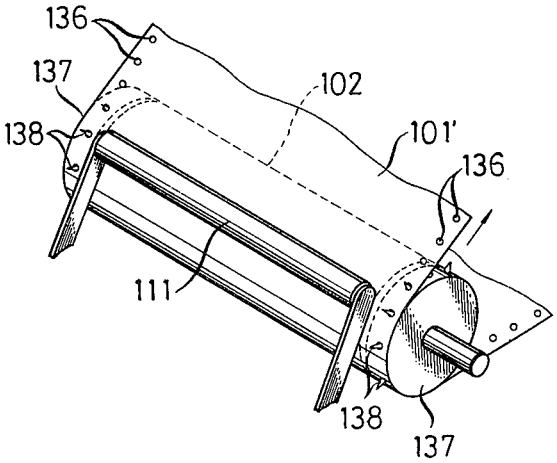
FIG. 13 is a perspective view of the page feeder used for feeding paper.

When the lever 117 is moved from the third position shown in FIG. 11 to the second position shown in FIG. 12, the pin 122 can be kept in engagement in the recess 130 with respect to the link 124 which is biased downwardly by the spring 133, so that the link 124 moves leftwardly as it is pressed by the pin 122 upon movement of the lever 117 in pivotal movement. This moves the paper bail 111 from the position in which it is away from the platen 102 to the position in which it is in contact with the platen 102, and the paper bail 111 is kept in contact with the platen 102 by the biasing force of the toggle spring 128 in a fourth condition. Meanwhile on the link 125 side, the pin 122 is located on the right end of the slot 131 when the lever 117 is in the third position, so that the pin 122 merely moves from the right end in the slot 131 when the lever 117 is moved to the second position, whereby the leftward displacement of the link 125 is prevented. Thus the pressure rollers 103 can be kept in the condition in which they are away from the platen 102. By moving the lever 117 from the third position to the second position as described hereinabove, it is possible to obtain the condition in which the paper bail 111 is in contact with the platen 102 and the pressure rollers 103 are away therefrom. This feature enables feeding of paper 101 without friction. In FIG. 13, paper 101' formed on opposite sides with sprocket apertures 136 is fed while sprockets 138 on the peripheral surface of pin wheels 137 disposed coaxially with the platen 102 are brought into engagement in the sprocket apertures 136. By the above feature, feeding of the paper 101' can be effected satisfactorily by the sprockets 138 because no excessive pressing and frictional forces are exerted on the paper 101' due to the pressure rollers 103 being away from the platen 102. If the paper bail 111 were away from the platen 102 at this time, it would be obstructive and interfere with the checking of the letters that have been printed, which results in a reduction in visibility. At the same time, the central portion of the paper 101' would tend to be separated from the platen 102 and the quality of the print obtained might be deteriorated. However, since the paper bail 111 is in engagement with the platen 102 and holds down the paper 101' according to the invention, it is possible to use a page feeder of the aforesaid construction without any trouble.

As the lever 117 is returned from the second position to the first position, the pin 122 is released from engagement in the recess 130 and is moved along the lower edge of the link 124, to be engaged in the recess 129 again, with respect to the link 124 which is unable to move further leftwardly because its movement is limited by the paper bail 111 in contact with the platen 102. Movement of the pin 122 which was located on the left end of the slot 131 on the link 125 side causes the link 125 to move leftwardly, to cause the link 126 and the release cam 114 to move clockwise in pivotal movement. Thus the pressure rollers 103 are brought into engagement with the platen 102 again by the biasing force of the plate spring 105. In this way, the apparatus is restored to its initial condition shown in FIG. 8.

Figure 14:
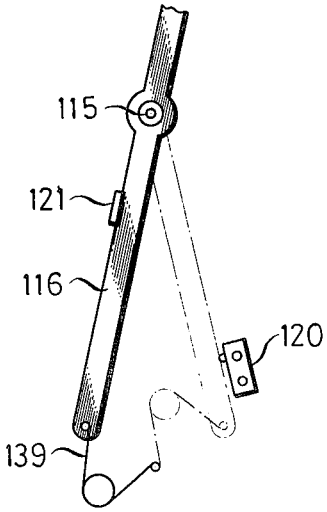
FIG. 14 shows a modification of the second embodiment of the invention.

In this embodiment, the automatic setting lever 116 is merely urged by the biasing force of the spring 119, and the switch 120 lacks self-holding capability when it is turned on. As shown in FIG. 14, a self-holding capability may be imparted to the apparatus when the lever 116 is moved from the first position to the second position by using a toggle spring 139. In the second embodiment, it is possible to cause feeding of paper 101' for a predetermined differential distance (to the top of the form, for example) to be effected again when the automatic setting lever 116 is returned to the first position and the switch 120 is turned off in a paper feeding operation as shown in the first embodiment, before the paper feeding operation is completed.

What is claimed is:

1. A semi-automatic paper insertion apparatus for a printer, a typewriter, etc. comprising a platen, a pair of pressure rollers arranged for engagement and disengagement with the platen, and a paper bail pivoted on a shaft for engagement and disengagement with the platen, the improvement wherein the semi-automatic paper insertion apparatus comprises means for bringing the pressure rollers into and out of engagement with the platen, a first lever movable in pivotal movement about a shaft and capable of occupying three different positions including a first position, a second position and a third position, and a linkage linking said means, said first lever and the paper bail to each other, said linkage being operative in such a manner that said paper bail alone is brought out of engagement with the platen when the lever is moved from the first position to the second position, that the pressure rollers are also brought out of engagement with the platen when the lever is moved from the second position to the third position, that the paper bail alone is brought into engagement with the platen when the lever is moved from the third position to the second position, and that the pressure rollers are also brought into engagement with the platen when the lever moves from the second position to the first position.

2. A semi-automatic paper insertion apparatus as claimed in claim 1, further comprising an automatic setting lever pivotable about the shaft supporting said first lever and movable between a first position and a second position, said automatic setting lever being operative to move the first lever from the first position to the second position as the automatic setting lever is moved from the first position to the second position, and means for detecting the movement of the automatic setting lever to the second position and generating a signal upon detection of the movement of the automatic setting lever to the second position to actuate a paper feed drive source.

* * * * *